US011548254B2

(12) United States Patent
Godden et al.

(10) Patent No.: US 11,548,254 B2
(45) Date of Patent: Jan. 10, 2023

(54) CARTON BLANK ERECTOR AND FEEDING AND SHUTTLE MACHINE

(71) Applicant: Kliklok LLC, Decatur, GA (US)

(72) Inventors: Kevin Godden, Bristol (GB); John Pate, Decatur, GA (US)

(73) Assignee: Kliklok LLC, Decatur, GA (US)

( * ) Notice: Subject to any disclaimer, the term of this patent is extended or adjusted under 35 U.S.C. 154(b) by 0 days.

(21) Appl. No.: 17/606,842

(22) PCT Filed: Apr. 29, 2020

(86) PCT No.: PCT/US2020/030462
§ 371 (c)(1),
(2) Date: Oct. 27, 2021

(87) PCT Pub. No.: WO2020/223343
PCT Pub. Date: Nov. 5, 2020

(65) Prior Publication Data

US 2022/0203644 A1 Jun. 30, 2022

Related U.S. Application Data

(60) Provisional application No. 62/840,066, filed on Apr. 29, 2019.

(51) Int. Cl.
*B31B 50/06* (2017.01)
*B31B 50/04* (2017.01)
*B31B 50/12* (2017.01)

(52) U.S. Cl.
CPC ..... *B31B 50/064* (2017.08); *B31B 50/042* (2017.08); *B31B 50/12* (2017.08)

(58) Field of Classification Search
CPC ..... B31B 50/02; B31B 50/022; B31B 50/04; B31B 50/042; B31B 50/064; B31B 50/07;
(Continued)

(56) References Cited

U.S. PATENT DOCUMENTS 3,952,478 A 4/1976 Richards et al.
4,062,535 A 12/1977 Charbonnet
(Continued)

FOREIGN PATENT DOCUMENTS

WO 2017/060375 A1 4/2017

OTHER PUBLICATIONS

United States Patent and Trademark Office, International Search Report issued in corresponding Application No. PCT/US2020/030462, dated Jul. 21, 2020.

*Primary Examiner* — Hemant Desai
*Assistant Examiner* — Jacob A Smith
(74) *Attorney, Agent, or Firm* — Michael S. Hargis; Stites & Harbison PLLC

(57) ABSTRACT

A carton feeding and shuttle machine includes first and second servo drives for driving first and second belts positioned on a plurality of pulleys, a first block attached to the first belt and supporting a first support shaft and a second block attached to the second belt and supporting a second support shaft. A controller controls the servo drives for driving the first and second belts. A linkage assembly includes a plurality of links configured to move a plucking head along a shaft in response to movements of the first and second belts. Specifically, relative movement of the first and second belts pivots first and third links about a first support shaft and second and fourth links about a second support shaft drawing a base along a slide shaft and extending the plucking head from a first position to a second position for engaging a carton blank in a carton blank stack.

25 Claims, 15 Drawing Sheets

(58) Field of Classification Search
CPC ..... B31B 50/102; B31B 50/12; B31B 2201/0241; B31B 2201/0264; B31B 2201/289; B65B 41/00; B65B 41/04; B65B 41/06; B65B 43/00; B65B 43/14; B65B 43/18
USPC ..... 493/334, 379, 84, 94, 76, 67, 344, 343
See application file for complete search history.

(56) References Cited

U.S. PATENT DOCUMENTS

| | | | | |
|---|---|---|---|---|
| 4,518,379 | A * | 5/1985 | Eldridge | B29C 66/43 156/509 |
| 4,573,957 | A | 3/1986 | Billberg | |
| 4,917,663 | A | 4/1990 | Pazdernik | |
| 5,019,029 | A | 5/1991 | Calvert | |
| 5,653,671 | A * | 8/1997 | Reuteler | B65H 1/24 53/381.1 |
| 5,988,625 | A | 11/1999 | DiRico | |
| 7,395,644 | B2 | 7/2008 | Rivenbark et al. | |
| 8,409,064 | B2 * | 4/2013 | Desertot | B31D 1/005 493/379 |
| 10,011,379 | B2 | 7/2018 | Baltes et al. | |
| 2008/0157461 | A1 | 7/2008 | Roth | |
| 2015/0143777 | A1 | 5/2015 | Rapp et al. | |
| 2016/0257089 | A1 | 9/2016 | Deering | |
| 2018/0169988 | A1 | 6/2018 | Somers, III | |

* cited by examiner

CARTON BLANK ERECTOR AND FEEDING AND SHUTTLE MACHINE

This application is a continuation of international patent application number PCT/US2020/030462 filed on Apr. 29, 2020, which in turn claims priority from U.S. Provisional Patent Application No. 62/840,066, filed Apr. 29, 2019, the disclosure of which is incorporated herein by reference.

TECHNICAL FIELD

This document relates generally to carton blank erectors, and more specifically to a carton blank feeding and shuttle machine.

BACKGROUND

Machines for forming cartons from blanks, and then delivering a product for loading into the carton, are well known. Typically, the carton is erected from a blank during a "pick and place" operation. This movement is traditionally accomplished by using two separate feeder and shuttle mechanisms. In addition, these mechanisms traditionally support carton blank stacks in an elevated position such that the blanks are plucked and subsequently transported to a lower position for forming into cartons. This requires the carton blank stacks to be lifted into position above the machine.

Accordingly, a need exists for an improved carton blank feeding and combined shuttle machine that avoids any one or all of the foregoing limitations, and perhaps others yet to be identified.

SUMMARY OF THE INVENTION

In accordance with the purposes and benefits described herein, a carton blank feeding and shuttle machine is provided. The carton feeding and shuttle machine may be broadly described as comprising first and second opposing sides, each side supporting a motor for driving a belt around a plurality of pulleys, first and second rods extending between the first and second opposing sides, a first end of the first rod attached to a first belt, a first end of the second rod attached to a second belt, and a second end of each rod supported for movement relative the first end, a plucking head supported by the first and second rods such that relative movement of the first and second belts moves the plucking head from a first position to a second position, and a controller controlling the motor of each side.

In one possible embodiment, the motor for driving a belt around a plurality of pulleys is a servo drive.

In another possible embodiment, the second end of the first rod is attached to a third belt and the second end of the second rod is attached to a fourth belt. In still another, the third and fourth belts are each driven.

In yet another possible embodiment, the first side supports a first motor and the second side supports a second motor, and the first motor drives the first and third belts and the second motor drives the second and fourth belts.

In still yet another possible embodiment, the belt driven by the motor supported by each side is a timing belt driven around first and second timing belt pulleys.

In still another possible embodiment, each end of the first and second rods is supported by a block. In another, the first end of the first rod is supported by a first block attached to the first belt, a first end of the second rod is supported by a second block attached to the second belt, a second end of the first rod is supported by a third block attached to a third belt, and a second end of the second rod is supported by a fourth block attached to a fourth belt.

In one other possible embodiment, the first side supports a first motor and the second side supports a second motor, and the first motor drives the first and third belts and the second motor drives the second and fourth belts.

In yet another possible embodiment, each side supports a guide rail. In another, the first belt is driven through a first guide rail and the second belt is driven through the second guide rail. In still another, each guide rail includes first and second guide tracks separated by a divider.

In still yet another possible embodiment, the second end of the first rod is attached to a third belt and the second end of the second rod is attached to a fourth belt, and wherein the first and fourth belts are separated by a first divider and the second and third belts are separated by a second divider.

In yet one other possible embodiment, the first and fourth belts move within first and second guide tracks of a first guide rail and the second and third belts move within first and second guide tracks of a second guide rail. In still another, the first and fourth belts and the first and second guide tracks of the first guide rail are separated by the first divider and the second and third belts and the first and second guide tracks of the second guide rail are separated by the second divider.

In one additional possible embodiment, the plucking head includes at least one linkage assembly supported by the first and second rods. In another, the plucking head further includes at least one vacuum cup attached to at least one support supported by the at least one linkage assembly. In still another, the plucking head further includes at least one support arm attached to the at least one support.

In another possible embodiment, the plucking head further includes at least one push arm attached to the at least one support.

In yet another possible embodiment, the linkage assembly includes a first link supported at a first end by a base and a second end by the first rod, a second link supported at a first end by the base and a second end by the second rod, a third link supported at a first end by the first rod and a second end by a head, and a fourth link supported at a first end by the second rod and a second end by the head, wherein relative movement of the first and second belts pivots the first and third links about the first rod and second and fourth links about the second rod drawing the base along a slide shaft and moving the head from the first position to the second position.

In still another possible embodiment, the linkage assembly further includes a fifth link supported at a first end by the first rod and a second end by the head and a sixth link supported at a first end by the second rod and a second end by the head.

In yet still another possible embodiment, the second end of the first link is positioned along the first rod between the first ends of the third and fifth links and the second end of the second link is positioned along the second rod between the first ends of the third and sixth links.

In still another possible embodiment, the plucking head includes first and second linkage assemblies supported by the first and second rods, and wherein a support bar extends between the first and second linkage assemblies and supports at least one vacuum cup attached to first and second supports associated with each linkage assembly.

In another possible embodiment, the plucking head further includes at least one support arm attached to each of the first and second supports associated with each linkage assembly. In another, the plucking head further includes at least one push arm attached to each of the first and second supports associated with each linkage assembly.

In still another possible embodiment, each of the first and second linkage assemblies includes a first link supported at a first end by a base and a second end by the first rod, a second link supported at a first end by the base and a second end by the second rod, a third link supported at a first end by the first rod and a second end by a head, and a fourth link supported at a first end by the second rod and a second end by the head, wherein relative movement of the first and second belts pivots the first and third links about the first rod and second and fourth links about the second rod drawing the base along a slide shaft and moving the head from the first position to the second position.

In yet another possible embodiment, each of the first and second linkage assemblies further includes a fifth link supported at a first end by the first rod and a second end by the head and a sixth link supported at a first end by the second rod and a second end by the head. In still another possible embodiment, the second end of the first link is positioned along the first rod between the first ends of the third and fifth links and the second end of the second link is positioned along the second rod between the first ends of the third and sixth links.

In one other possible embodiment, the first and second opposing sides are attached to a frame. In another, the carton blank feed and shuttle machine further includes a take-away conveyor attached to the frame. In yet another, the carton blank feed and shuttle machine further includes a carton former attached to the frame. In still another, the carton blank feed and shuttle machine further includes at least one door attached to the frame. In yet still another, the carton blank feed and shuttle machine further includes an input device attached to the frame. In another possible embodiment, the input device is a display. In yet another, the display is a touch screen and in an additional possible embodiment, the carton blank feed and shuttle machine further includes an extendable arm attached to the frame, the extendable arm supporting the display.

In yet another possible embodiment, the carton blank feeding and shuttle machine further includes a hopper attached to the frame.

In still another possible embodiment, the hopper is configured to support at least one stack of carton blanks such that a next-in-line carton blank can be secured by the plucking head from a side of the at least one stack of carton blanks facing the first and second sides.

In still yet another possible embodiment, the hopper includes a plurality of guides extending generally perpendicular to a face of the hopper for guiding the carton blanks onto the carton blank stack.

In another possible embodiment, the hopper includes a tray, at least one tab extending into an aperture defined by a face of the hopper, and a roller bar extending across the aperture for supporting a stack of carton blanks. In another possible embodiment, the roller bar extends across the face of the hopper and between a lower edge of the aperture and a midway point. In yet another, the roller bar extends across the face of the hopper about one fourth of the total height of the aperture from the lower edge.

In one other possible embodiment, the hopper is configured to support the stack of carton blanks such that a next-in-line carton blank can be secured by the plucking head from a side of the at least one stack of carton blanks facing the frame.

In another possible embodiment, a carton blank erector is provided. The carton blank erector may be broadly described as comprising a frame supporting at least one of a carton former and a take-away conveyor, a feeding and shuttle machine including (a) first and second opposing sides, each side supporting a motor for driving a belt around a plurality of pulleys, (b) first and second rods extending between the first and second opposing sides, a first end of the first rod attached to a first belt, a first end of the second rod attached to a second belt, and a second end of each rod supported for movement relative the first end, and (c) a plucking head supported by the first and second rods such that relative movement of the first and second belts moves the plucking head from a first position to a second position, and a controller controlling the motor of each side.

In still another possible embodiment, the carton blank erector further includes at least one door attached to the frame. In another, the carton blank erector further includes an input device attached to the frame. In another possible embodiment, the input device is a display. In still another, the carton blank erector further includes an extendable arm attached to the frame and supporting the display.

In yet another possible embodiment, the carton blank erector further includes a hopper attached to the frame.

In still yet another possible embodiment, the hopper is configured to support at least one stack of carton blanks such that a next-in-line carton blank can be secured by the plucking head from a side of the at least one stack of carton blanks facing the first and second sides.

In another possible embodiment, hopper includes a plurality of guides extending generally perpendicular to a face of the hopper for guiding the carton blanks onto the carton blank stack.

In one other possible embodiment, the hopper includes a tray, at least one tab extending into an aperture defined by a face of the hopper, and a roller bar extending across the aperture for supporting a stack of carton blanks.

In yet another possible embodiment, the hopper is configured to support the stack of carton blanks such that a next-in-line carton blank can be secured by the plucking head from a side of the at least one stack of carton blanks facing the frame.

In another possible embodiment, the roller bar extends across the face of the hopper and between a lower edge of the aperture and a midway point. In still another, the roller bar extends across the face of the hopper about one fourth of the total height of the aperture from the lower edge.

In one other possible embodiment, the motor for driving a belt around a plurality of pulleys is a servo drive.

In still another possible embodiment, the second end of the first rod is attached to a third belt and the second end of the second rod is attached to a fourth belt. In another, the third and fourth belts are each driven.

In yet another possible embodiment, the first side supports a first motor and the second side supports a second motor, and the first motor drives the first and third belts of the at least one belt and the second motor drives the second and fourth belts of the at least one belt.

In still yet another possible embodiment, the belt driven by the motor supported by each side is a timing belt driven around first and second timing belt pulleys.

In another possible embodiment, each end of the first and second rods is supported by a block.

In yet another possible embodiment, the first end of the first rod is supported by a first block attached to the first belt, a first end of the second rod is supported by a second block attached to the second belt, a second end of the first rod is supported by a third block attached to a third belt, and a second end of the second rod is supported by a fourth black attached to a fourth belt.

In another possible embodiment, the first side supports a first motor and the second side supports a second motor, and the first motor drives the first and third belts of the at least one belt and the second motor drives the second and fourth belts of the at least one belt.

In yet still another possible embodiment, each side supports a guide rail. In another, the first belt is driven through a first guide rail and the second belt is driven through the second guide rail. In still another, each guide rail includes first and second guide tracks separated by a divider.

In one other possible embodiment, the second end of the first rod is attached to a third belt and the second end of the second rod is attached to a fourth belt, and wherein the first and fourth belts are separated by a first divider and the second and third belts are separated by a second divider. In another possible embodiment, the first and fourth belts move within first and second guide tracks of a first guide rail and the second and third belts move within first and second guide tracks of a second guide rail. In yet still another, the first and fourth belts and the first and second guide tracks of the first guide rail are separated by the first divider and the second and third belts and the first and second guide tracks of the second guide rail are separated by the second divider.

In another possible embodiment, the plucking head includes at least one linkage assembly supported by the first and second rods. In another, the plucking head further includes at least one vacuum cup attached to at least one support supported by the at least one linkage assembly. In still another, the plucking head further includes at least one support arm attached to the at least one support. In yet still another, the plucking head further includes at least one push arm attached to the at least one support.

In one other possible embodiment, the linkage assembly includes a first link supported at a first end by a base and a second end by the first rod, a second link supported at a first end by the base and a second end by the second rod, a third link supported at a first end by the first rod and a second end by a head, and a fourth link supported at a first end by the second rod and a second end by the head, wherein relative movement of the first and second belts pivots the first and third links about the first rod and second and fourth links about the second rod drawing the base along a slide shaft and moving the head from the first position to the second position.

In another possible embodiment, the linkage assembly further includes a fifth link supported at a first end by the first rod and a second end by the head and a sixth link supported at a first end by the second rod and a second end by the head. In still another, the second end of the first link is positioned along the first rod between the first ends of the third and fifth links and the second end of the second link is positioned along the second rod between the first ends of the third and sixth links.

In yet another possible embodiment, the plucking head includes first and second linkage assemblies supported by the first and second rods, and wherein a support bar extends between the first and second linkage assemblies and supports at least one vacuum cup attached to first and second supports associated with each linkage assembly. In another possible embodiment, the plucking head further includes at least one support arm attached to each of the first and second supports associated with each linkage assembly. In still another possible embodiment, the plucking head further includes at least one push arm attached to each of the first and second supports associated with each linkage assembly.

In one other possible embodiment, each of the first and second linkage assemblies includes a first link supported at a first end by a base and a second end by the first rod, a second link supported at a first end by the base and a second end by the second rod, a third link supported at a first end by the first rod and a second end by a head, and a fourth link supported at a first end by the second rod and a second end by the head, wherein relative movement of the first and second belts pivots the first and third links about the first rod and second and fourth links about the second rod drawing the base along a slide shaft and moving the head from the first position to the second position. In still another possible embodiment, each of the first and second linkage assemblies further includes a fifth link supported at a first end by the first rod and a second end by the head and a sixth link supported at a first end by the second rod and a second end by the head.

In another possible embodiment, the second end of the first link is positioned along the first rod between the first ends of the third and fifth links and the second end of the second link is positioned along the second rod between the first ends of the third and sixth links.

In another possible embodiment, a carton blank feeding and shuttle machine for plucking a next-in-line carton from a stack of cartons supported by a hopper of a carton erector is provided. The carton feeding and shuttle machine may be broadly described as comprising a plurality of rods extending between and attached to first and second sides, a first servo drive supported by the first side for moving a first belt supported by a first group of pulleys supported by the second side, a second servo drive supported by the second side for moving a second belt supported by a second group of pulleys supported by the first side, a first end of a first rod attached to the first belt, a first end of a second rod attached to the second belt, and a second end of each rod supported by one of the first and second sides for movement with the first end, a head supported by the first and second rods such that movement of the first and second belts moves the head along a transfer path and relative movement of the first and second belts moves the head from a first position to a second position, and a controller controls the first and second servo drives.

In yet another possible embodiment, the first servo drive moves a third belt supported by a third group of pulleys supported by the first side, and the second servo drive moves a fourth belt supported by a fourth group of pulleys supported by the second side.

In still another possible embodiment, each end of the first and second rods is supported by a block. In still yet another possible embodiment, the first end of the first rod is supported by a first block attached to the first belt, a first end of the second rod is supported by a second block attached to the second belt, a second end of the first rod is supported by a third block attached to the third belt, and a second end of the second rod is supported by a fourth block attached to the fourth belt.

In one other possible embodiment, each of the first and second sides supports a guide rail.

In another possible embodiment, the first belt is driven through the first guide rail and the second belt is driven through the second guide rail. In yet another, each of the first and second guide rails includes first and second guide tracks separated by a divider.

In still yet another possible embodiment, the first and fourth belts move within first and second guide tracks of the first guide rail and the second and third belts move within first and second guide tracks of the second guide rail.

In one other possible embodiment, the head includes at least one linkage assembly supported by the first and second rods. In another, the head further includes at least one vacuum cup supported by the at least one linkage assembly. In still another, the head further includes at least one support arm attached to the at least one linkage assembly. In yet still another, the head further includes at least one push arm attached to the at least one support arm.

In another possible embodiment, the linkage assembly includes a first link supported at a first end by a base and a second end by the first rod, a second link supported at a first end by the base and a second end by the second rod, a third link supported at a first end by the first rod and a second end by a head, and a fourth link supported at a first end by the second rod and a second end by the head, wherein relative movement of the first and second belts pivots the first and third links about the first rod and second and fourth links about the second rod drawing the base along a slide shaft and moving the head from the first position to the second position.

In one other possible embodiment, the linkage assembly further includes a fifth link supported at a first end by the first rod and a second end by the head and a sixth link supported at a first end by the second rod and a second end by the head.

In yet another possible embodiment, the second end of the first link is positioned along the first rod between the first ends of the third and fifth links and the second end of the second link is positioned along the second rod between the first ends of the third and sixth links.

In another aspect of the invention, a method of shuttling a carton blank from an initial position to an intermediate position includes the steps of: (a) driving first and second belts such that relative movement between the first and second belts extends a plucking head from a first position toward a carton stack supported by a hopper; (b) engaging a next-in-line carton blank in the initial position at a bottom of the carton stack; (c) further driving the first and second belts such that the next-in-line carton blank is pulled from the initial position in the carton stack and transported to the intermediate position; (d) releasing the next-in-line carton blank in the intermediate position; and (e) further driving the first and second belts such that the head is returned to the carton stack for engaging a subsequent next-in-line carton blank in the initial position at the bottom of the carton stack.

In another possible embodiment, the method may further include the steps of: (f) further driving the first and second belts such that the subsequent next-in-line carton blank is pulled from the carton stack and transported toward the intermediate position; (g) engaging the next-in-line carton blank in the intermediate position and moving the next-in-line carton blank from the intermediate position toward a forward position; (h) releasing the subsequent next-in-line carton blank in the intermediate position; and (i) further driving the first and second belts such that the head is again returned to the carton stack for engaging a subsequent next-in-line carton blank in the initial position at the bottom of the carton stack.

In still another possible embodiment, the engaging step includes applying a vacuum pressure to a vacuum cup attached to the head sufficient to secure the next-in-line carton blank to the vacuum cup.

In yet still another possible embodiment, the releasing step includes removing the vacuum pressure to the vacuum cup.

In one other possible embodiment, the step of further driving the first and second belts such that the next-in-line carton blank is pulled from the initial position in the carton stack and transported to the intermediate position includes the steps of driving the first and second belts such that (a) relative movement of the first and second belts retracts the head pulling the next-in-line carton blank from the initial position and (b) common movement of the first and second belts moves the next-in-line carton blank from the initial position to the intermediate position along a transfer path.

In the following description, there are shown and described several embodiments of carton feeding and shuttle machines, a carton blank erectors including the carton feeding and shuttle machine, and related methods. As it should be realized, the machines are capable of other, different embodiments and their several details are capable of modification in various, obvious aspects all without departing from the machines as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the carton blank erectors, feeding and shuttle machines, and related methods and together with the description serve to explain certain principles thereof. In the drawing figures.

Figure 9:
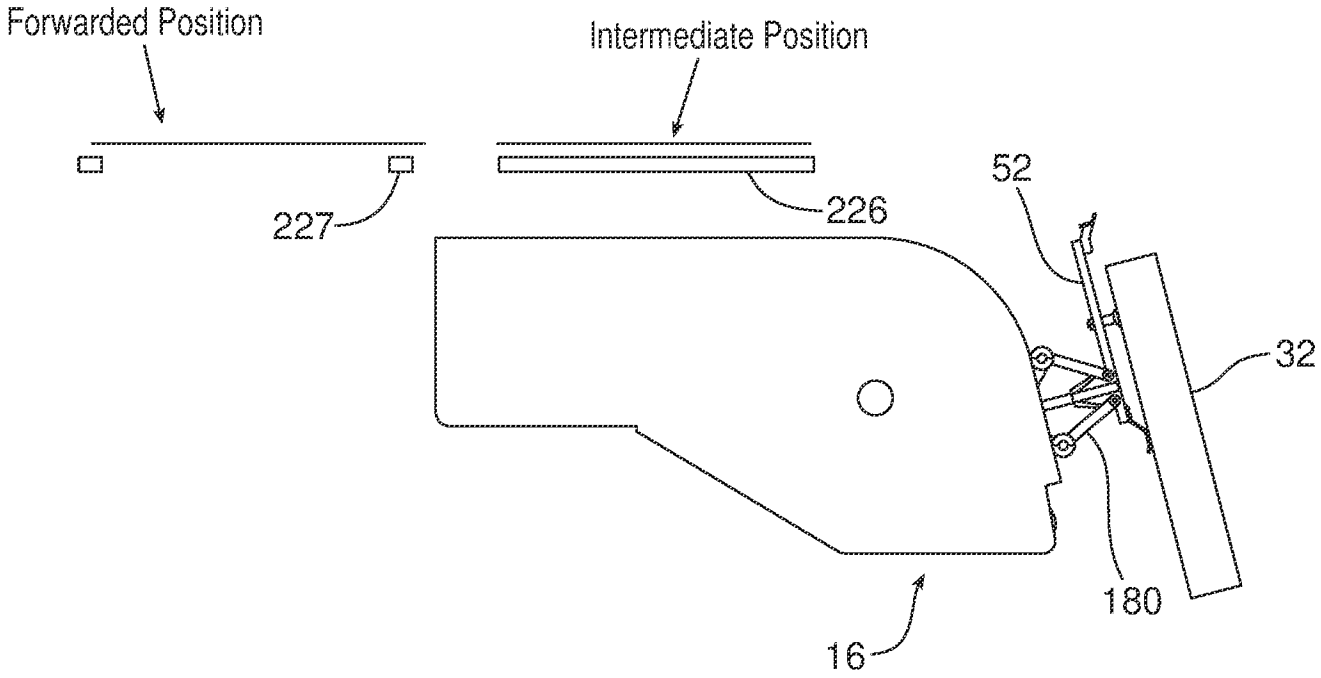

FIG. 9 is a section view of relevant portions of the erector and the carton feeding and shuttle machine illustrating an extended linkage assembly and corresponding plucking head engaging a next-in-line carton of a carton stack in a plucking position; and FIGS. 10A-10F are sequential section views of relevant portions of the erector and the carton feeding and shuttle machine illustrating movement of a linkage assembly and corresponding plucking head through a complete cycle of movement from a plucking position, toward an intermediate position above the carton feeding and shuttle machine, past the intermediate position pushing an intermediate-position-carton toward a forward position, and back to the plucking position.

Reference will now be made in detail to the present embodiments of the carton feeding and shuttle machine and related methods of staging a carton for subsequent forming, examples of which are illustrated in the accompanying drawing figures, wherein like numerals are used to represent like elements.

DETAILED DESCRIPTION

Figure 1:
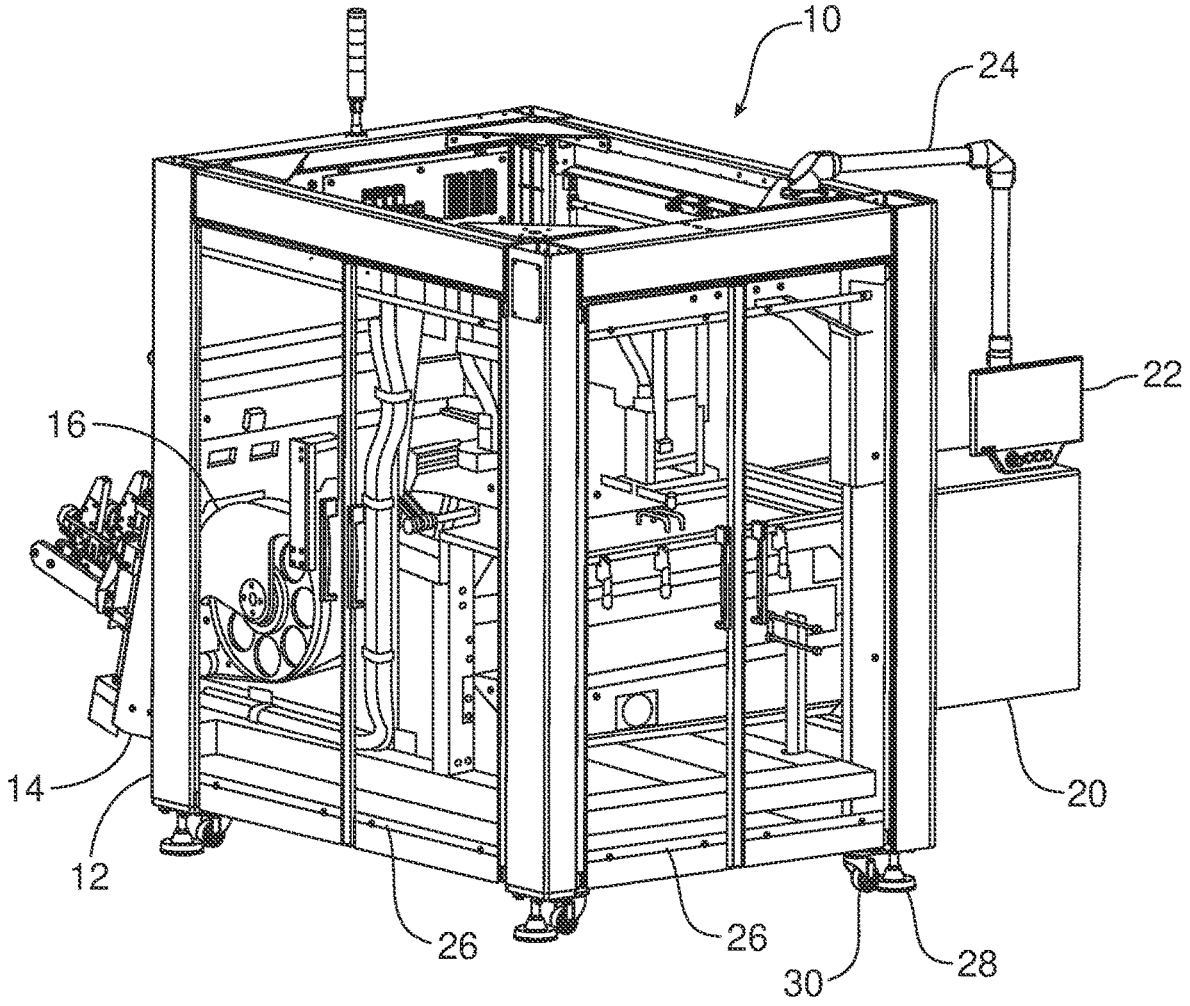
FIG. 1 is a perspective view of a carton blank erector.

Reference is now made to FIG. 1 which illustrates an overall perspective view of one embodiment of a carton blank erector 10. While the term carton blank describes a typically flat material which is formed into a carton, carton blanks will simply be referred to as cartons throughout the specification. As shown in both FIGS. 1 and 2, the carton erector 10 includes a frame 12 supporting a hopper 14, a carton feeding and shuttle machine 16, a carton former 18 including a takeaway conveyor 20, and an input device 22 mounted on an extendable arm 24. As is known in the art, a plurality of see-through doors 26 are positioned on each side of the frame 12 other than the hopper side. The plurality of see-through doors 26 minimize the risk of an object entering a carton erecting area (generally within the frame 12) while allowing operator(s) to visually monitor the carton feeding, shuttling, and forming operations occurring within the area. As shown, the frame 12 is supported by extendable, leveling feet 28 at each corner and casters 30. The feet 28 support the erector 10 in a stationary position during use, shipment, or storage and the casters 30 support the erector for movement during non-use. In some embodiments, the casters may be retractable and/or one or more locking casters may be utilized in lieu of feet, or the erector may utilize solely feet, or neither.

Figure 3:
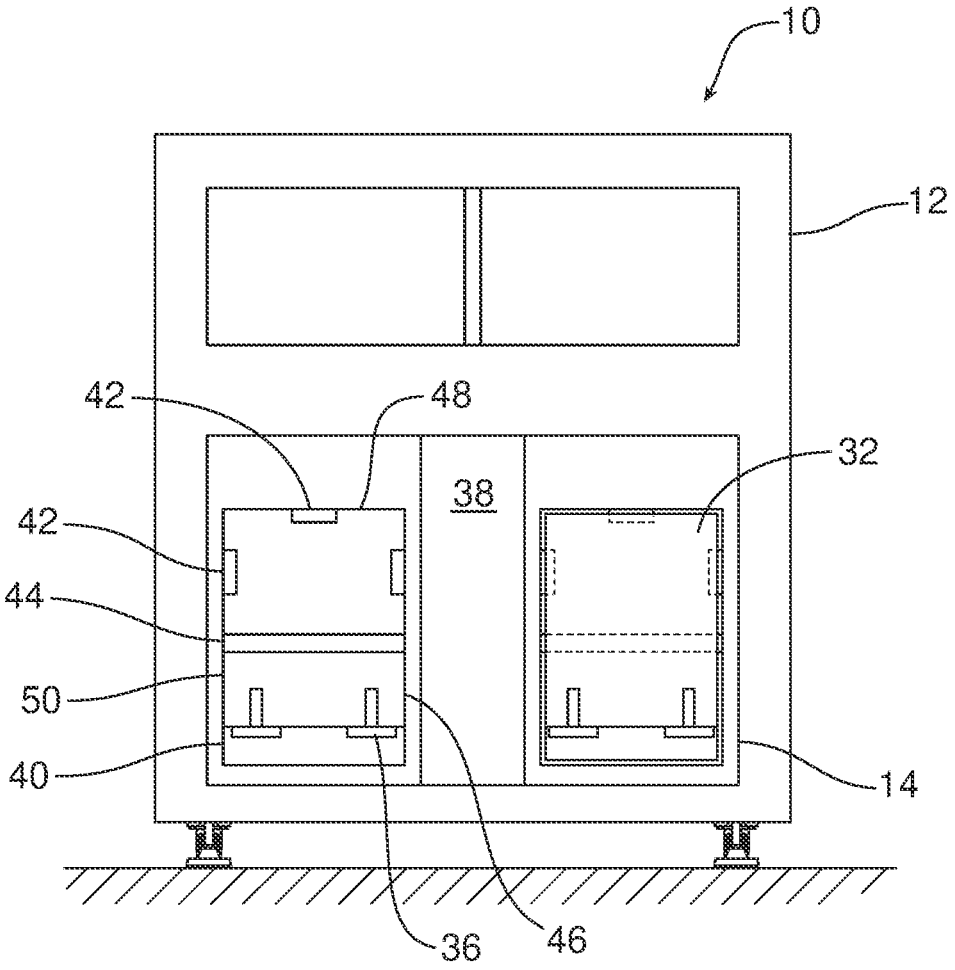
FIG. 3 is an end plan view of a carton blank erector illustrating a hopper configured to support first and second carton blank stacks and shown supporting a second carton blank stack on a right-side of the hopper.

As shown in FIG. 3, the hopper 14 is an ergonomic low-level hopper configured to support first and second carton stacks 32 such that a next-in-line carton can be picked or plucked from a side of the stacks facing the carton feeding and shuttle machine 16. In other words, the next-in-line carton is picked from a bottom of the carton stacks 32. In other embodiments, fewer or more carton stacks may be supported by the hopper 14. In one embodiment, for example, an erector with three carton stacks may be utilized. In such an arrangement, as with the described two stack embodiment, the carton feeding and shuttle machine acts to pluck, move, and form a carton from each stack in a combined operation. In this manner, the erector 10 can form two, three or more times as many cartons compared to an erector with a single carton stack. The remainder of the description, however, will treat the erector 10 as if its hopper 14 supports a single carton stack 32.

As further shown, a plurality of guides 36 extend generally perpendicular to a face 38 of the hopper 14. The guides 36 guide the cartons in the carton stack 32 into position during placement onto the hopper 14 and limit lateral movement of the cartons during operation. A hopper tray 40 in combination with one or more tabs 42 and a roller bar 44 support the carton stack 32 in position on the hopper 14. More specifically, the tray 40 prevent the cartons within the carton stack 32 from sliding down the hopper face 38 and the one or more tabs 42 and roller bar 44 prevent the carton stack from falling through a generally rectangular or other carton-shaped aperture 46 defined by the hopper face through which a next-in-line carton travels when plucked or pulled from the carton stack.

The roller bar 44 extends across the aperture 46 in the hopper face 38 and between a lower edge of the aperture (not visible in FIG. 3 due to the tray 40) and a midway point and, in the described embodiment, is positioned about one fourth of the total height of the aperture above the lower edge. In this arrangement, the one or more tabs 42 are positioned along an upper edge 48 and side edges 50 of the aperture. The one or more tabs 42 extend into the aperture 46 sufficient to prevent the carton stack 32, including the next-in-line carton, from falling through the aperture. In the described embodiment, the one or more tabs 42 extend into the aperture 46 approximately one quarter of an inch or so. In operation, one or more plucking heads 52 grasps an upper portion of the next-in-line carton pulling a flexing upper portion thereof past the one or more tabs 42 and through the aperture 46 while a lower portion of the next-in-line carton flexes horizontally around the roller bar 44. As the carton feeding and shuttle machine 16 moves the plucking heads 52 and the next-in-line carton from its initial position within the carton stack 32 toward an intermediate position, the next-in-line carton is pulled upward, through the aperture 46, and away from the carton stack 32. This plucking action and carton movement is described in greater detail below.

Figure 2:
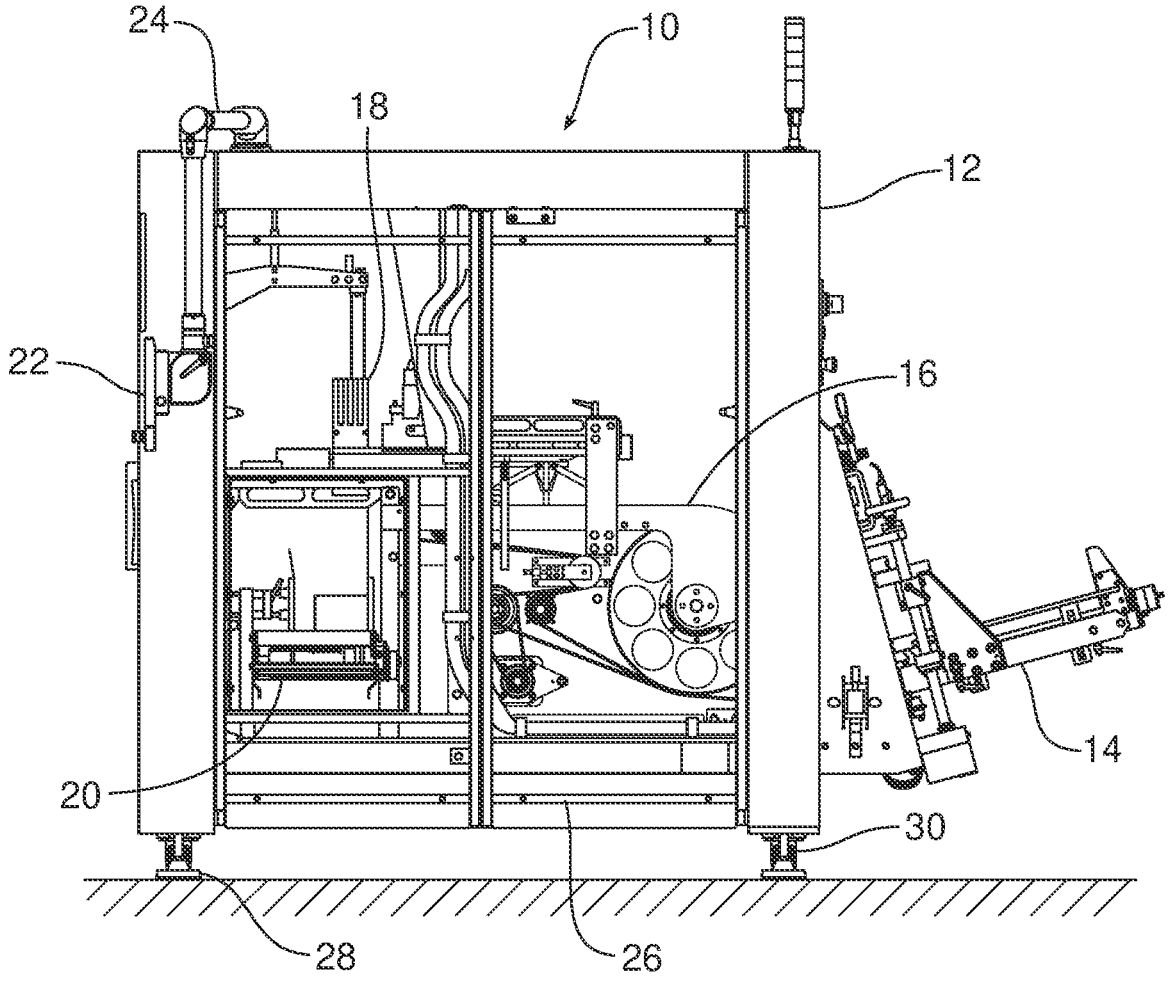
FIG. 2 is a side plan view of a carton blank erector.
Figure 4:
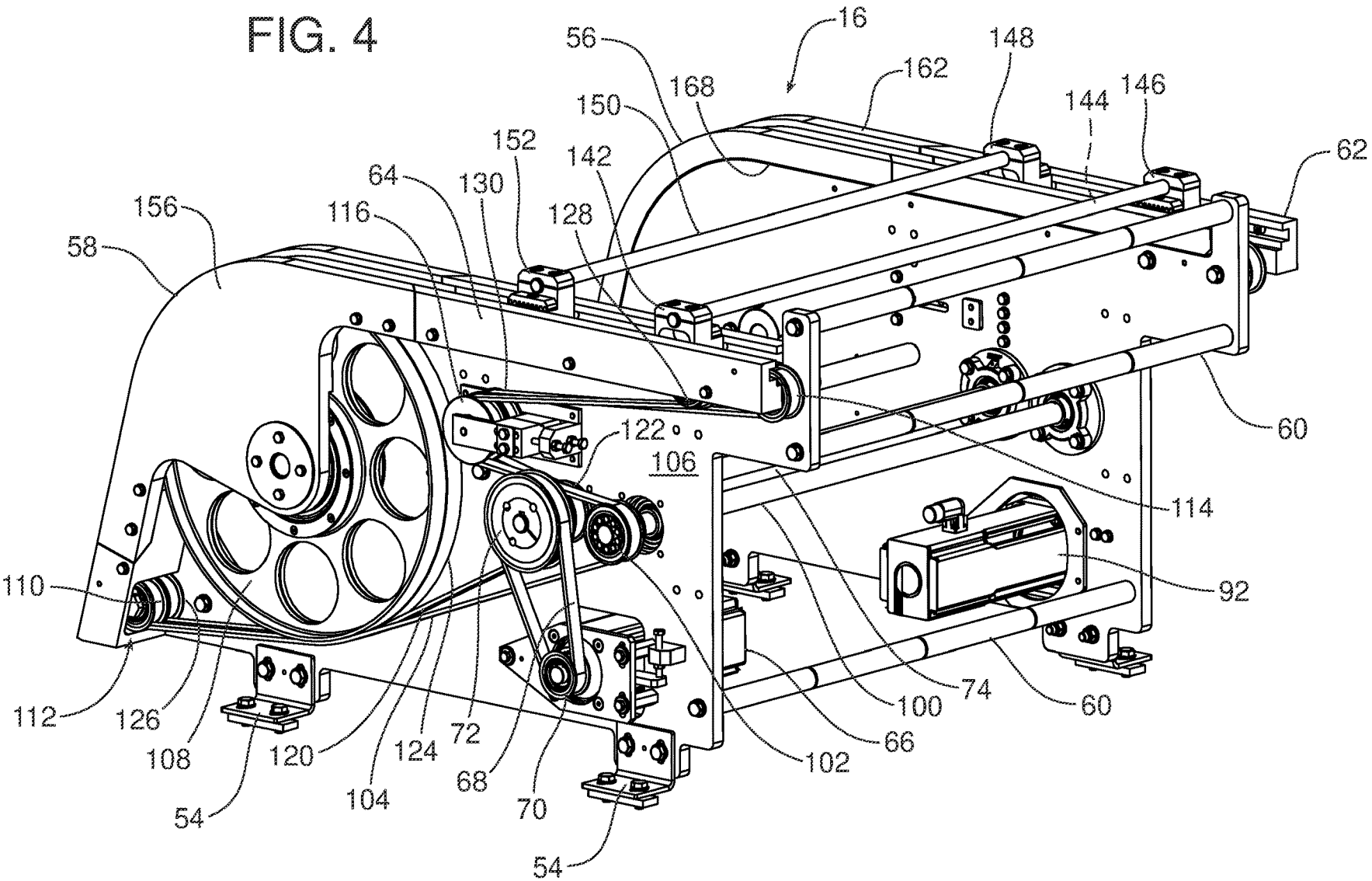
FIG. 4 is a perspective view of a carton feeding and shuttle machine with carton plucking heads and corresponding linkage assemblies removed.

FIG. 4 illustrates a perspective view of the carton feeding and shuttle machine 16 which is supported by the frame 12 as shown in FIGS. 1 and 2. In the described embodiment, a plurality of angle brackets 54 are used to attach the carton feeding and shuttle machine 16 to corresponding supports of the frame 12 using bolts or other fastening means. Returning to FIG. 4, the carton feeding and shuttle machine 16 includes opposing sides 56, 58 attached together via a plurality of static rods 60 extending therebetween. In other embodiments, the rods may be square or L-shaped bars, or any other shaped rigid material and the length thereof may vary as well depending on a desired width of the carton feeding and shuttle machine 16. The opposing sides 56, 58 are essentially mirror images of one another in the described embodiment but work together to create motion and relative motion for control of the plucking heads 52 as will be described in greater detail below.

As shown, side 58 of the carton feeding and shuttle machine 16 supports a first servo drive 66 which drives a timing belt 68. More specifically, a drive shaft of servo drive 66 extends through a first timing belt pulley 70. Rotation of the drive shaft imparts motion to the first timing belt pulley 70 and timing belt 68 which in turn rotates a second timing belt pulley 72. Rotation of the second timing belt pulley 72 rotates a transfer shaft 74 extending between sides 56 and 58, causing rotation of a drive pulley 76 supported by side 56, shown in FIG. 5.

Figure 5:
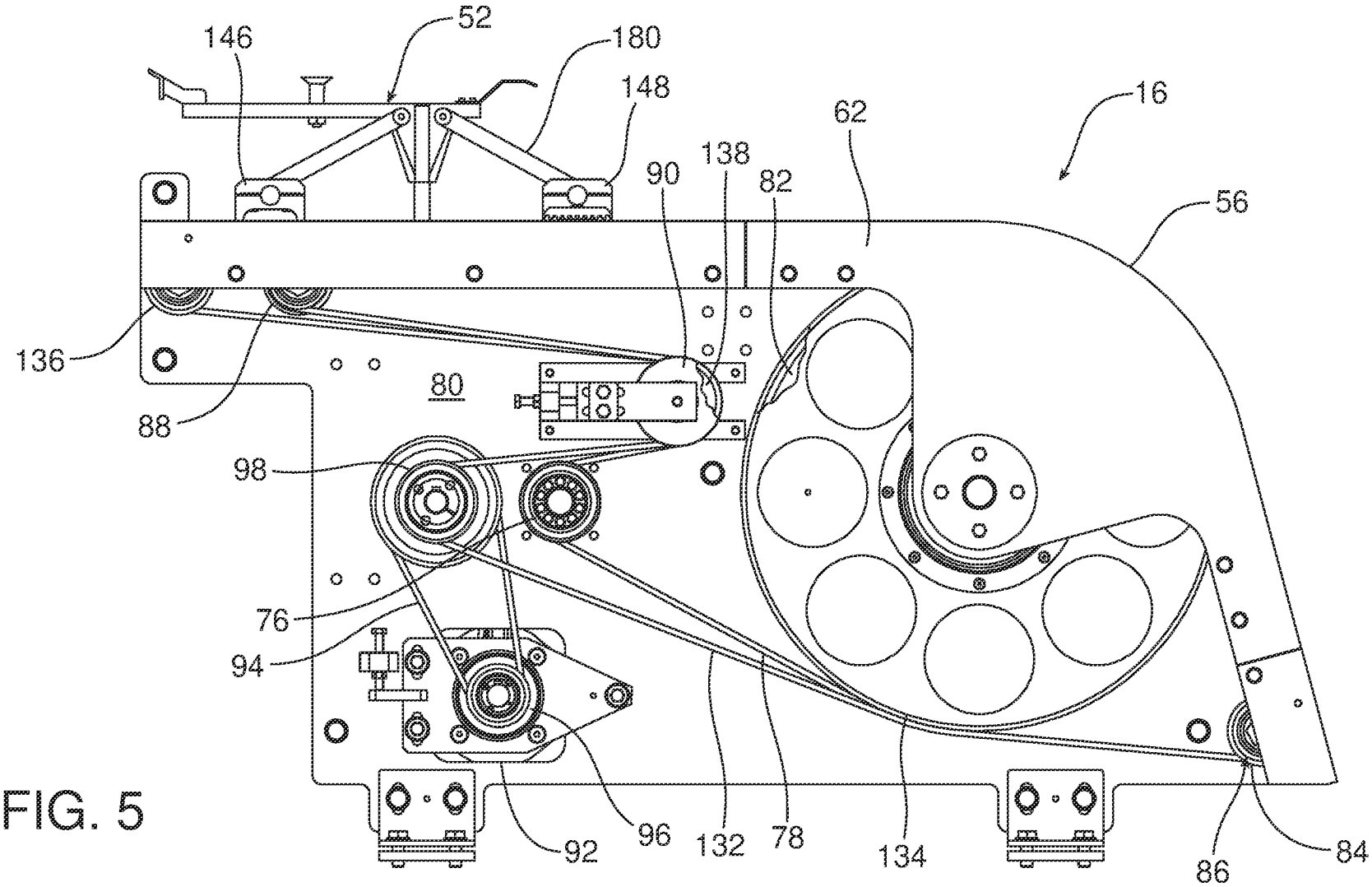
FIG. 5 is a side plan view of the carton feeding and shuttle machine.

As further shown in FIG. 5, rotation of the drive pulley 76 moves a drive belt 78 along a circuitous path adjacent a sidewall 80 of side 56. The drive belt path extends from drive pulley 76 along a guide wheel 82, a first idler pulley 84 of a double idler pulley 86, back along the guide wheel, through a guide rail 62, around idler pulley 88 and tensioner pulley 90, and back to the drive pulley. Also shown in FIG. 5, side 56 supports a second servo drive 92 which drives a timing belt 94. Again, a drive shaft of servo drive 92 extends through a first timing belt pulley 96. Rotation of the drive shaft imparts motion to the first timing belt pulley 96 and timing belt 94 which in turn rotates a second timing belt pulley 98. Rotation of the second timing belt pulley 98 rotates a transfer shaft 100, extending between sides 56 and 58, causing rotation of a drive pulley 102 supported by side 58, shown in FIG. 4.

Staying with FIG. 4, rotation of the drive pulley 102 moves a drive belt 104 along a circuitous path adjacent a sidewall 106 of side 58. The drive belt path extends from drive pulley 102 along a guide wheel 108, a first idler pulley 110 of a double idler pulley 112, back along the guide wheel, through a guide rail 64, around idler pulley 114 and tensioner pulley 116, and back to the drive pulley.

Rotation of the second timing belt pulley 72 caused by movement of the timing belt 68 also imparts motion to a third belt 120 along a different circuitous path adjacent the sidewall 106 of side 58. The third belt path extends from pulley 122 along a guide wheel 124, a second idler pulley 126 of the double idler pulley 112, back along the guide wheel, through the guide rail 64, around idler pulley 128 and a tensioner pulley 130, and back to the pulley 122. Similarly, as shown in FIG. 5, rotation of the second timing belt pulley 98 caused by movement of the timing belt 94 also imparts motion to a fourth belt 132 along another circuitous path adjacent the sidewall 80 of side 56. The fourth belt path extends from a pulley, not shown but positioned between the second timing belt pulley 98 and the sidewall 80 on shaft 100, along a guide wheel 134, a second idler pulley of the double idler pulley 84, back along the guide wheel 134, through the guide rail 62, around idler pulley 136 and a second tensioner pulley 138, and back to the pulley positioned between the second timing belt pulley 98 and the sidewall 80 on shaft 100.

Figure 6:
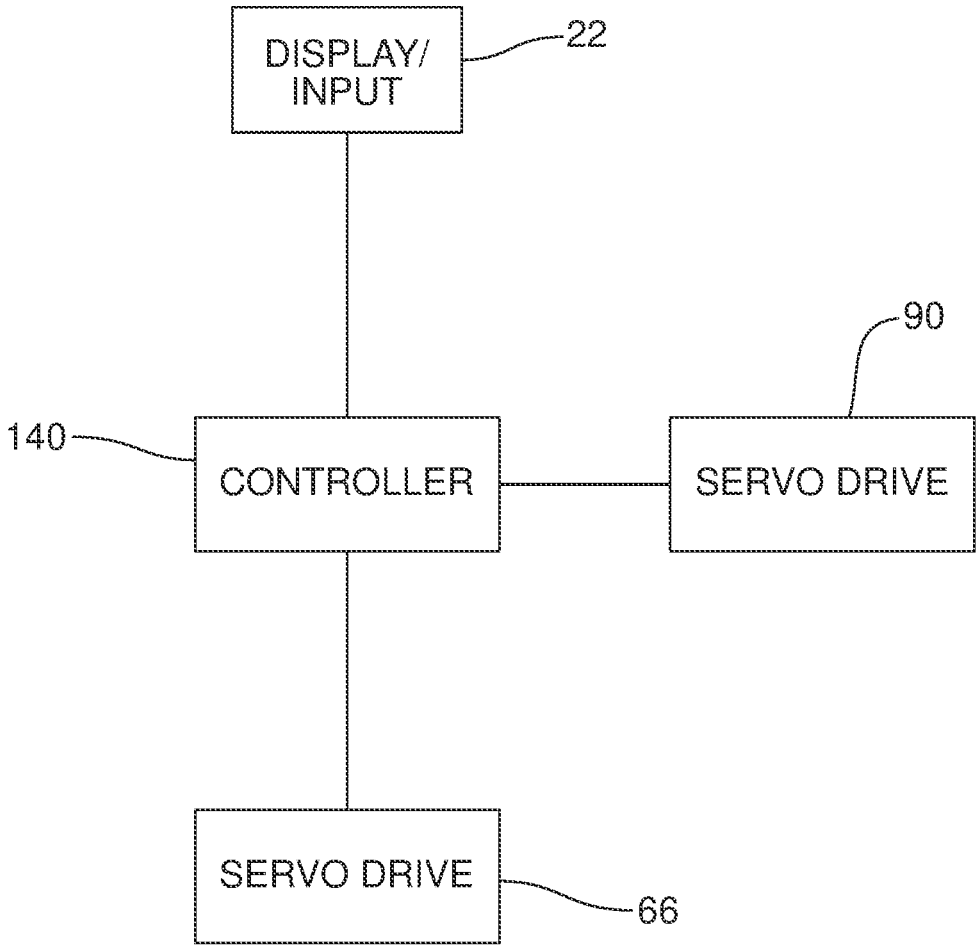
FIG. 6 is a schematic block diagram including a user display/input, a controller, and first and second servo drives.

As is known in the art, the servo drives 66 and 90 are utilized to provide precise location control for the first and second (drive) belts 78 and 104, via timing belts 94 and 68 respectively, throughout use. As schematically illustrated in FIG. 6, the servo drives 66 and 90 receive command signals from a controller 140/control system, amplify the signals, and transmit electric currents to servo motors of the servo drives in order to produce motion proportional to the command signals which, in this instance, represent desired positions. The command signals may be generated via user input through input device 22, for example, or other input. In the described embodiment, the input device 22 is a touch screen display. As suggested and described above, each of the first and second drive belts 78 and 104 is individually servo driven via its respective timing belt. However, the drive belts work together to create the motion and the relative motion for control of the plucking heads 52 mentioned above and described in more detail below.

Figure 7:
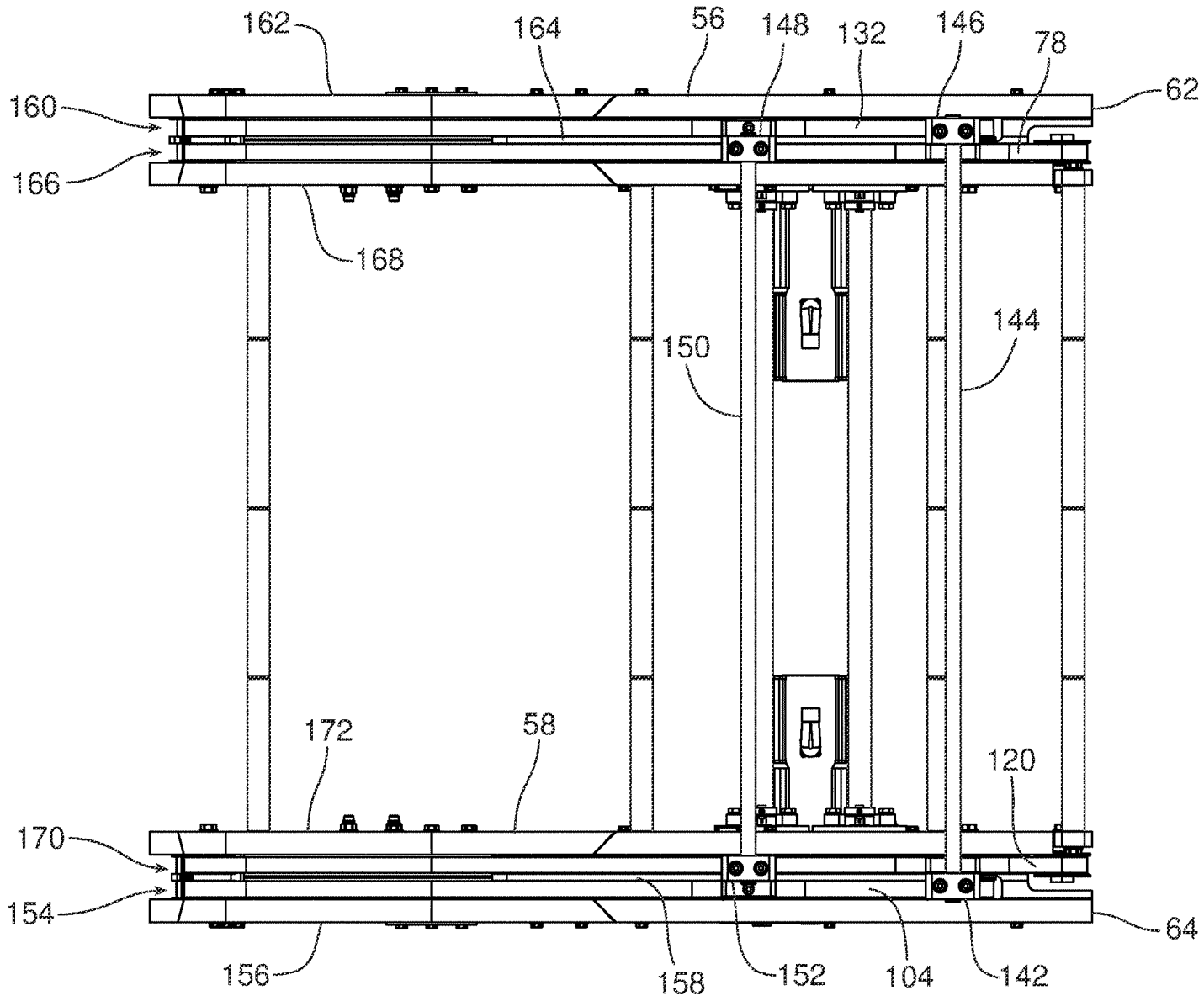
FIG. 7 is a top view of the carton feeding and shuttle machine with carton plucking heads and corresponding linkage assemblies removed.

As best shown in FIG. 7, a pivot block 142 is attached to drive belt 104 for movement therewith within a guide track 154. The guide track 154 extends within the guide rail 64 between an outer wall 156 and a divider 158. The divider 158 extends between the guide tracks 154 and 170 to ensure separation of the belts 104 and 120 during movement through the guide rail 64. A support rod 144 extends between pivot block 142 and a corresponding pivot block 146 attached to belt 132 such that the pivot blocks 142 and 146 form a first pivot block pair. Pivot block 146 is similarly attached to drive belt 132 for movement therewith within a guide track 160 that extends within the guide rail 62 between an outer wall 162 and a divider 164.

As further shown, another pivot block 148 is attached to drive belt 78 for movement therewith within a guide track 166. The guide track 166 extends within the guide rail 62 between an inner wall 168 and the divider 164. The divider 164 extends between the guide tracks 160 and 166 to ensure separation of the belts 132 and 78 during movement through the guide rail 62. A support rod 150 extends between pivot block 148 and a corresponding pivot block 152 attached to belt 120 such that the pivot blocks 148 and 152 form a second pivot block pair. Pivot block 152 is similarly attached to drive belt 120 for movement therewith within a guide track 170 that extends within the guide rail 64 between an inner wall 172 and the divider 158.

Figure 8:
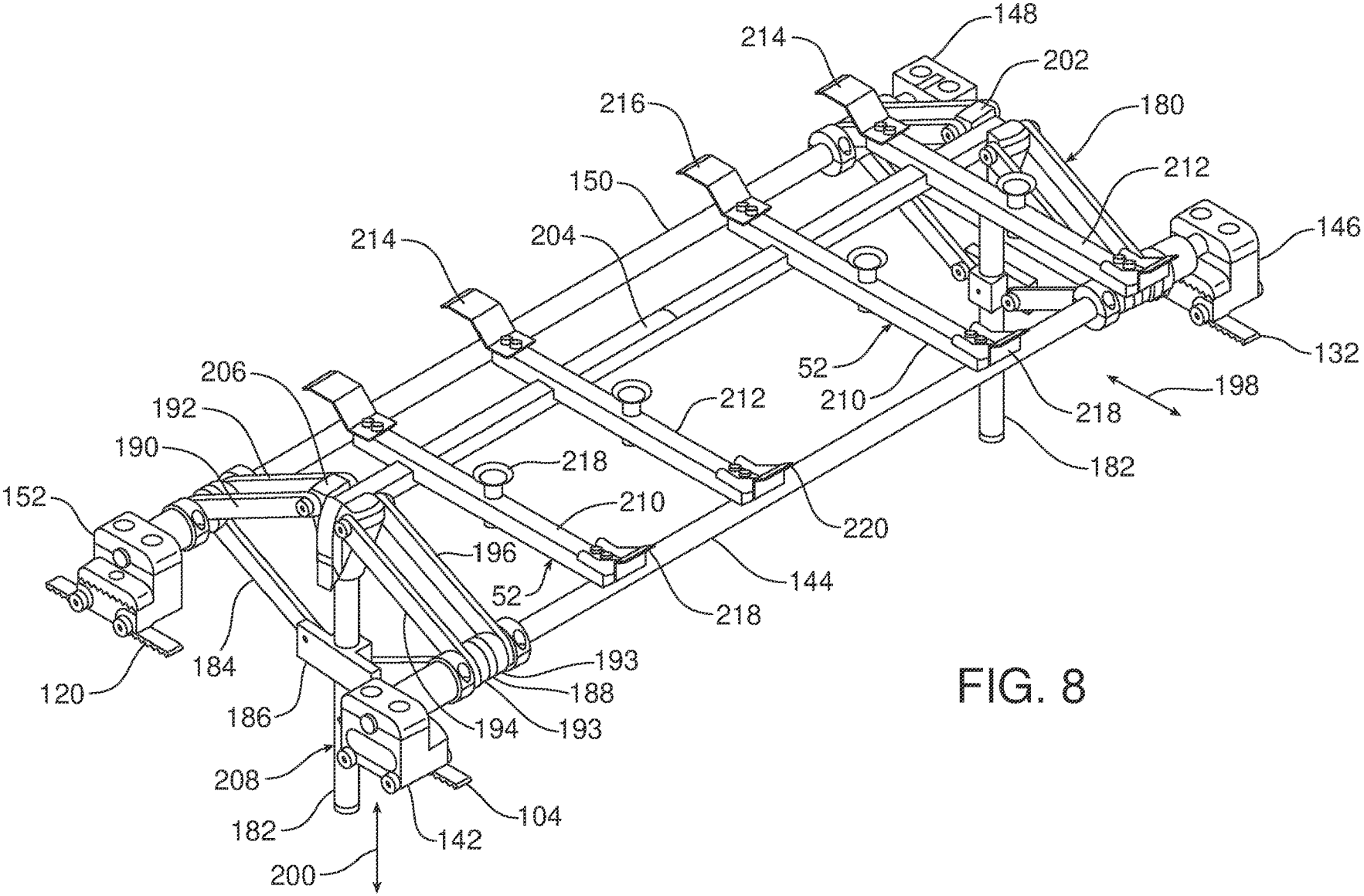
FIG. 8 is a perspective view of the carton plucking heads and corresponding linkage assemblies supported by support rods and corresponding pivot blocks of the carton feeding and shuttle machine.

In operation, common motions of the servo drives 66 and 90 move the first and second pairs of opposing pivot blocks to create motion to move the plucking heads 52 along a transport path while small differences in motion between the servo drives 66 and 90 move the first and second pairs of opposing pivot blocks to create relative motion to control the plucking heads 52 via a corresponding one or more linkage assemblies 180. In the described embodiment shown in FIG. 8, the carton feeding and shuttle machine 16 utilizes two plucking heads 52 and corresponding linkage assemblies 180 for plucking cartons from the first and second carton stacks 32. Each plucking head 52 and corresponding linkage assembly 180 are the same and only one such head and assembly will be described in detail. As noted above, however, one or more plucking heads and corresponding linkage assemblies may be used in different embodiments of the invention.

As shown, the linkage assembly 180 includes a plurality of links interconnected to pivot about the support rods 144 and 150. In the described embodiment, six links are interconnected, however, alternate embodiments may utilize fewer or more links to achieve the desired motion along a shaft 182. As shown, a first link 184 is supported by or attached to a base 186 at a first end and supported by support rod 150 at a second end. Similarly, a second link 188 is supported by or attached to the base 186 at a first end and supported by support rod 144 at a second end. Third and fifth links 190, 192 are supported at first ends by support rod 150.

The support rod 150 extends through apertures in the first ends of the third and fifth links 190, 192 and the second end of the first link 184 such that the second end of the first link 184 is essentially sandwiched between the first ends of the third and fifth links. Spacers 193 may be positioned along rod 150 between the links 184, 190, and 192. Similarly, third and sixth links 194, 196 are supported at first ends by support rod 144. The support rod 144 extends through apertures in the first ends of the third and sixth links 194, 196 and the second end of the second link 188 such that the second end of the second link 188 is essentially sandwiched between the first ends of the third and sixth links. Again, spacers 193 may be positioned along rod 144 between the links 188, 194, and 196. Second ends of the third and fifth links 190, 192 and second ends of the third and sixth lengths 194, 196 are attached to or supported by a head 202 attached to the shaft 182.

A support bar 204 extends between head 202 of the first linkage assembly 180 and a head 206 of a second linkage assembly 208. As shown, the support bar 204 supports first and second plucking heads 52. In the described embodiment, each plucking head 52 includes first and second supports 210 and 212 for supporting the next-in-line carton throughout transport, push arms 214 and 216 for moving a carton in an intermediate position to a forward position, and support arms 220 and 222. Each plucking head 52 further includes at least one vacuum tool or vacuum cup 218 for grasping the next-in-line carton as is known in the art. Although some type of vacuum hose(s) or line(s) is attached to each cup to apply a facility provided vacuum or suction force to a face of the next-in-line carton upon engagement in order to grasp the carton, the hose(s) or line(s) are not shown for clarity. In the described embodiment, each of the first and second supports 210 and 212 support a vacuum cup 218.

As suggested throughout, relative movement of at least one of the pivot block pairs (shown by action arrows 198) within their respective guide rails causes rotation of the links about the support rods 144, 150 resulting in movement of the shaft 182 and heads 202 and 206 (shown by action arrows 200). More specifically, the shaft 182 travels through the base 186 drawing the heads 202 and 206 closer to or pushing the heads away from the base. This movement allows the plucking heads 52 to move from a first to a second position. In the described movement, the plucking heads 52 extend from the first position toward the next-in-line carton to the second or plucking position for plucking. Further movement allows the plucking heads 52 to retract to allow unfettered movement of the plucking heads and plucked carton between an initial position where the carton is a part of the carton stack 32 and the intermediate position where the carton is released from the plucking heads onto a tray.

In the plucking position, as shown in FIG. 9, the plucking head 52 is extended such that the vacuum cup 218 is engaging or grasping the next-in-line carton in its initial position within the carton stack 32. It should be noted that an amount of extension of the plucking head 52 and/or various stop positions along the path may be adjusted, as noted above, through operator intervention, whilst the carton feeding and shuttle machine is cycling or otherwise, to accommodate variations within the system (e.g., bowed carton compensation). For instance, an operator may adjust an extension length of the plucking head 52 utilizing "up" and "down" arrows shown on the input device 22 to accommodate bowing of cartons within the carton stacks 32 or other less than optimal conditions.

Figure 10A:
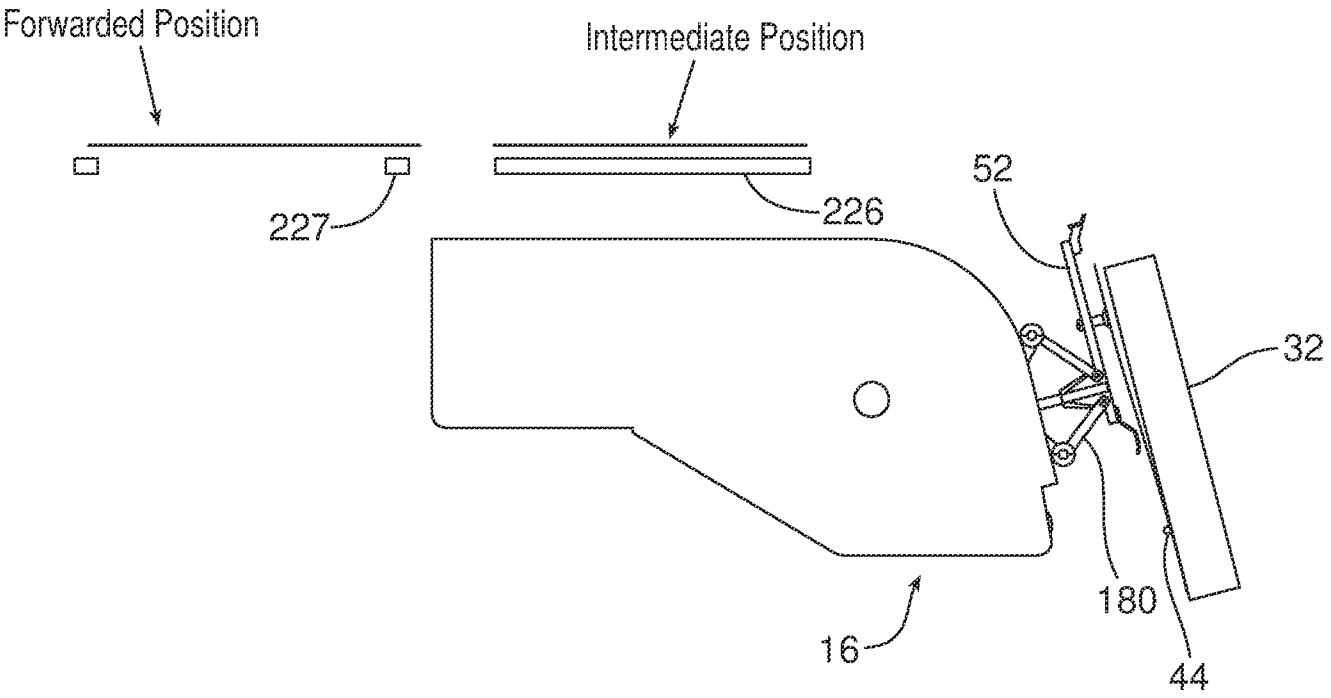

As described above, the plucking head 52 engages and grasps an upper portion of the next-in-line carton in the plucking position as illustrated in FIG. 10A. Once engaged, the plucking head 52 is retracted along shafts 182 via relative movement of the pivot blocks pairs. This movement pulls the flexing upper portion of the next-in-line carton past the tabs 42 and through the aperture 46 while the lower portion of the next-in-line carton flexes horizontally around the roller bar 44. The servo drives 66 and/or 92 ensure that the plucking head 52 is generally perpendicular to a contact face of the carton blank being plucked.

Figure 10B:
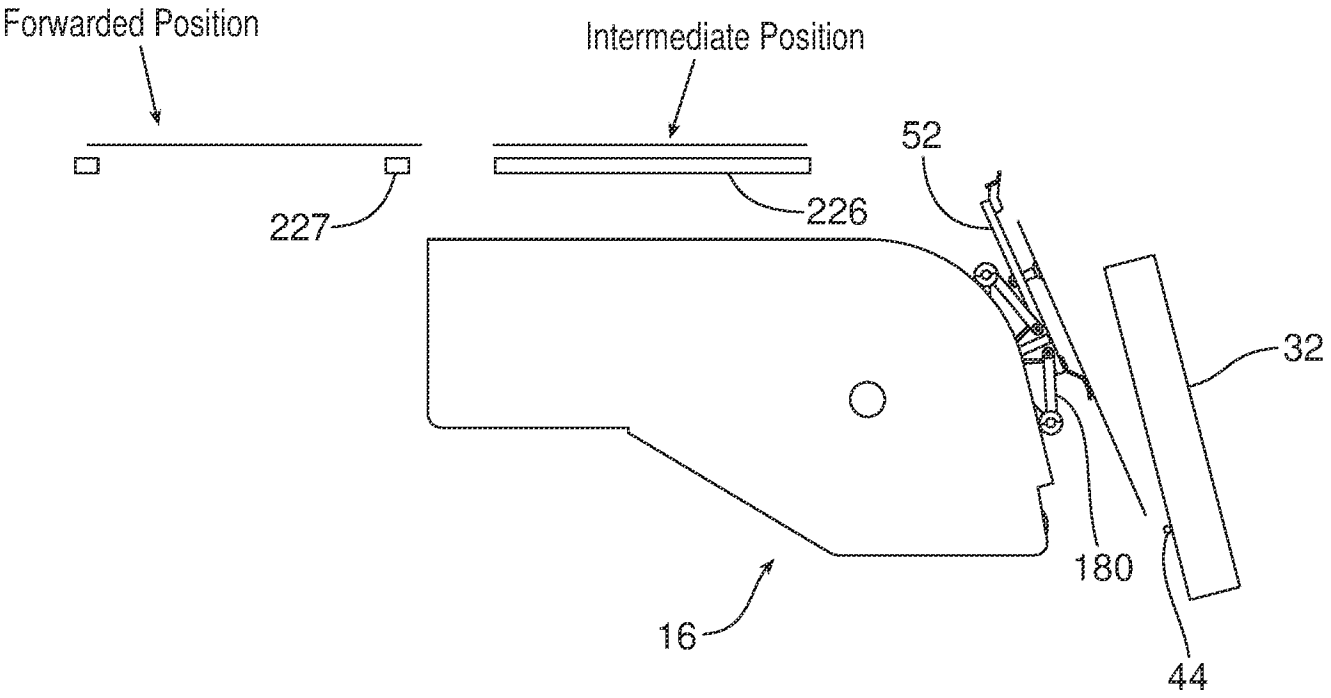

Once at least the upper portion of the next-in-line carton is pulled through the aperture 46 or simultaneously therewith, the carton feeding and shuttle machine 16 initiates movement of the linkage assemblies 180, the plucking head 52, and the grasped carton toward an intermediate position as illustrated in FIG. 10B. In the described embodiment, the intermediate position is resting upon a support tray 226 positioned above the carton feeding and shuttle machine 16 and generally horizontal as illustrated in FIG. 9. Moving the linkage assemblies 180 and plucking head 52 necessarily moves the grasped carton pulling the lower portion over the roll bar 44 and through the aperture 46. Retraction of the plucking head 52 from the plucking position continues throughout this movement at least sufficient to allow a lower end of the next-in-line carton pulled through the aperture to avoid contacting the hopper 14 and/or a subsequent next-in-line carton in the carton stack 32 as shown in FIGS. 10B and 10C.

Figure 10C:
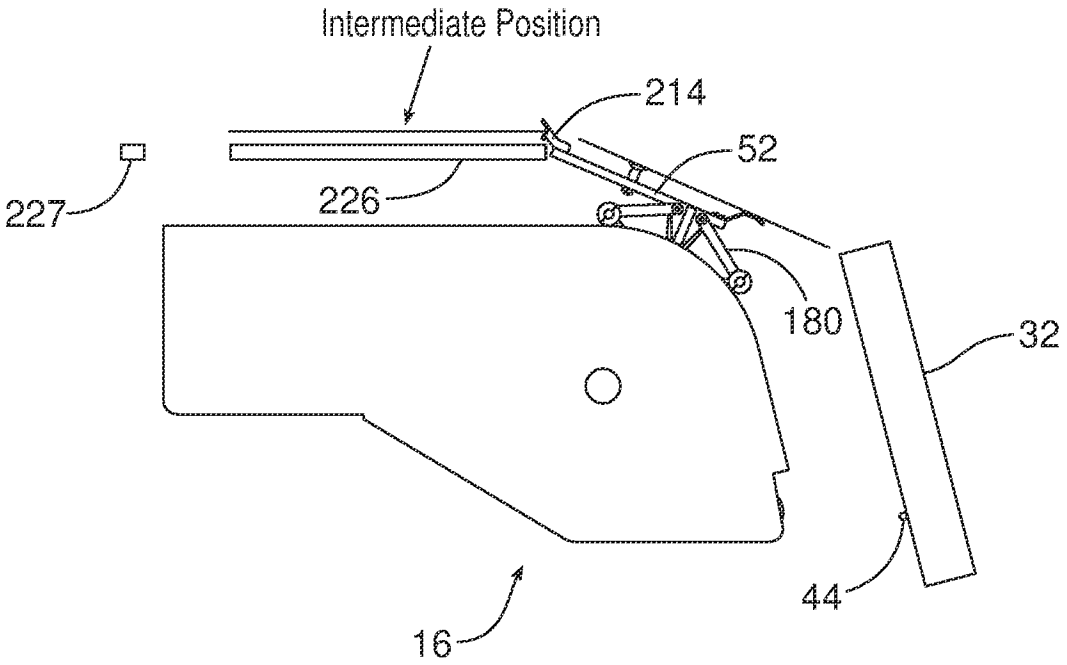

As further illustrated in FIG. 10C, the next-in-line carton is transported along a transport path from its initial position toward the intermediate position where support tray 226 is already supporting an intermediate-position-carton. As the plucking head 52 and carton-in-transport approach the intermediate position, the linkage assemblies 180 extend to raise the carton-in-transport above the tray 226 and the push arms 214 and 216 positioned along a leading edge of the plucking head 52 engage the intermediate-position-carton pushing the carton from the support tray 226 and toward a forward position as shown in FIG. 4 and sequentially illustrated in FIGS. 10C and 10D. In the forward position, the erector 10 can perform one or more next machine functions such as forming the carton and subsequently conveying the formed carton away from the erector. These machine functions are generally represented in FIGS. 10A-10F by reference numeral 227. Take-away conveyor belts and carton forming machines, or machines for performing other functions within the carton forming process are generally known in the art and will not be described in detail herein. It should be noted, however, that glue nozzles 228 may be positioned adjacent the support tray 226 for depositing glue or adhesive onto passing cartons in support of the forming function as is known in the art. Even more, water nozzles may be positioned where the glue nozzles 228 are shown adjacent the support tray 226 and other components and/or tooling for sealing cartons using ultrasonic methods as is also known in the art may also be utilized.

Figure 10D:
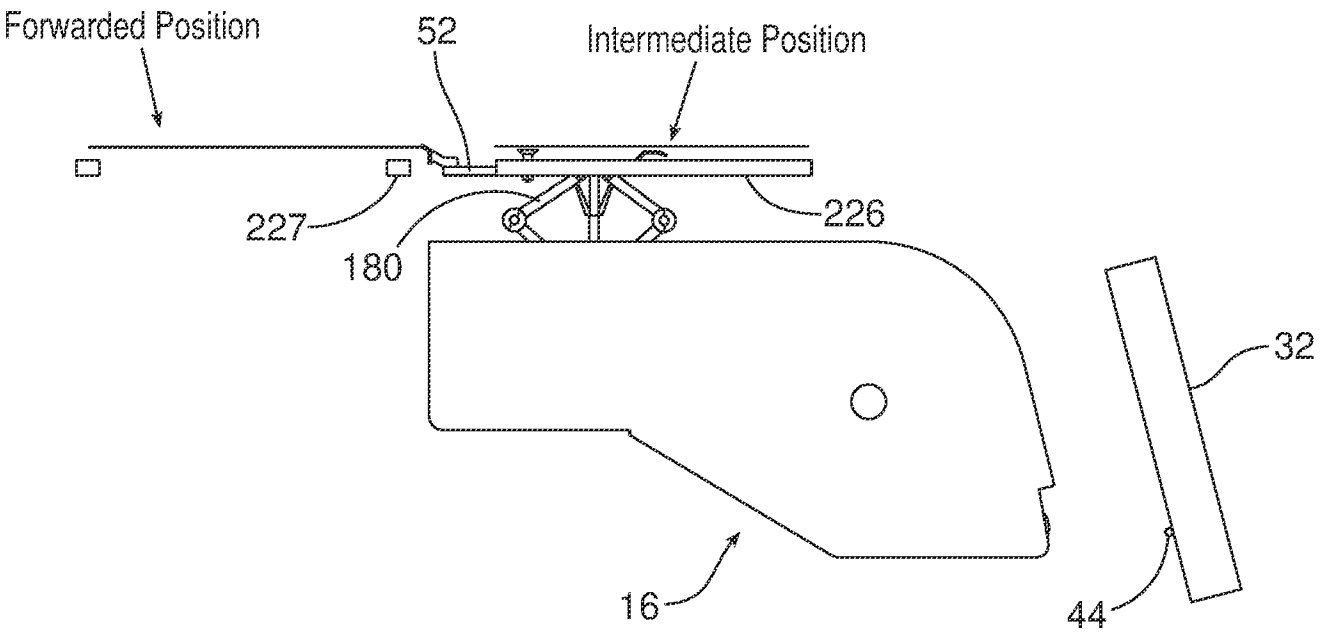
Figure 10E:
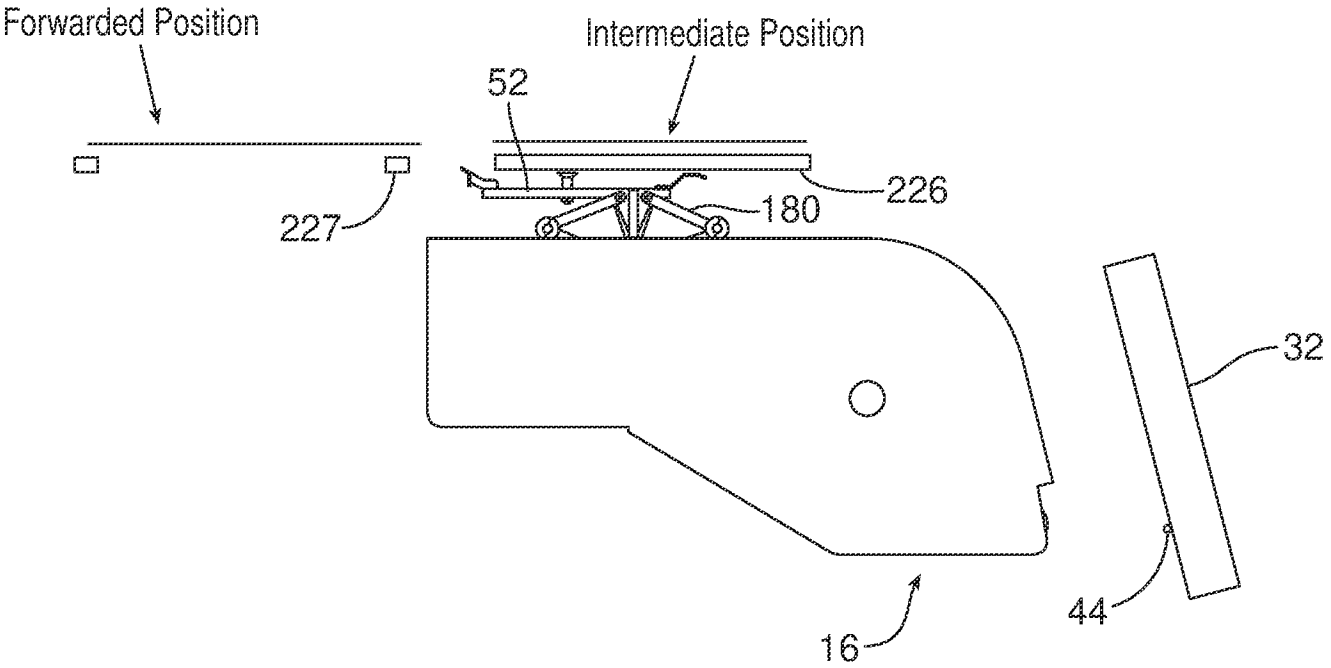
Figure 10F:
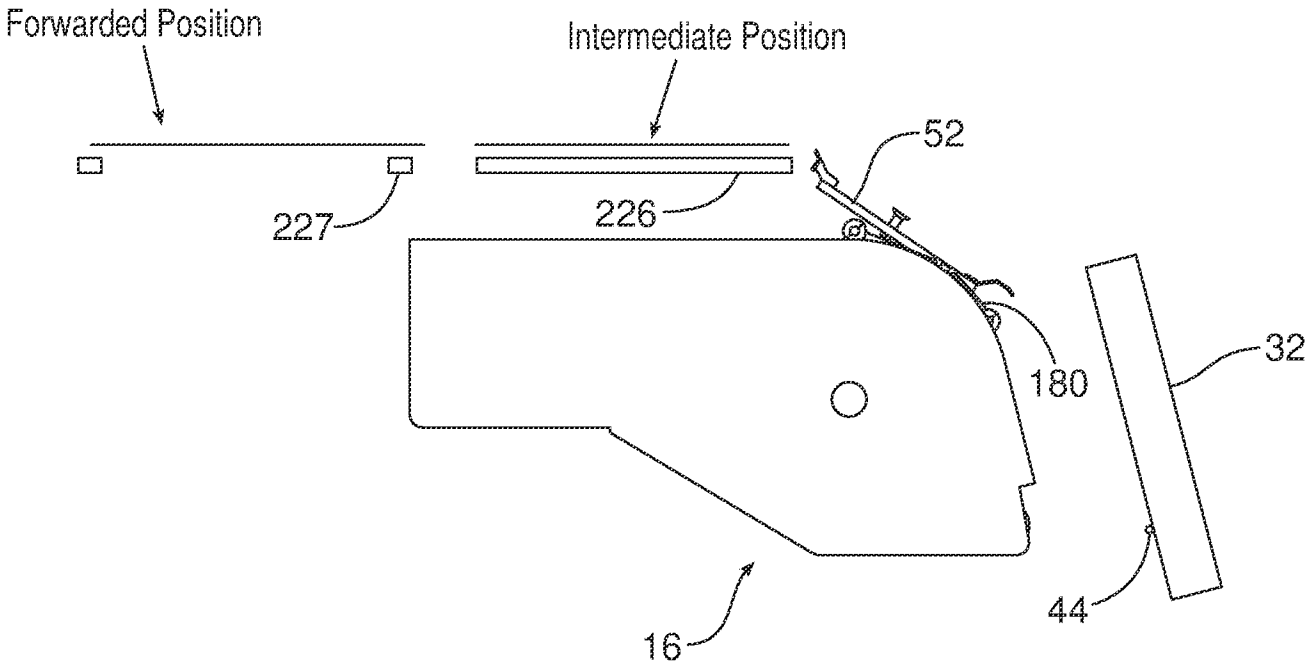

Reiterating, the plucking head 52 is moved and retracted pulling the next-in-line carton through the aperture 46 and clear of the next-in-line carton and the hopper 14. Subsequently, the plucking head 52 is extended while moving the carton-in-transport along the transport path sufficient to clear the support tray 226. With the carton-in-transport in position above the support tray 226 and having pushed the intermediate-position-carton toward the forward position, the vacuum pressure is removed from the vacuum cups 52 releasing the carton-in-transport onto the support tray in the intermediate position. As the carton-in-transport is released, becoming a subsequent intermediate-position-carton, the plucking head 52 continues moving forward along the transport path in engagement with and pushing the intermediate-position-carton to the forward position as illustrated in FIGS. 10D and 10E. The actions of initially engaging and pushing the intermediate-position-carton toward the forward position, releasing the carton-in-transport onto the support tray 226, and continuing to engage and push the intermediate-position carton to the forward position occur in a generally continuous manner such that the movement appears fluid.

With the intermediate-position-carton pushed to the forward position, the plucking head 52 is subsequently retracted enough to allow the push arms 214 and 216 to clear the support tray 226 during return travel along the transport path back toward the carton stack 32 where the cycle of movement is repeated and a subsequent next-in-line carton is engaged and transported along the transport path to the intermediate position. It should be noted that the path the carton travels during operation produces an ergonomic low-level carton hopper position combined with the servo control that allows for infinitely changeable carton pick and shuttle programmed positions. In this manner, the machine can be used with varying other cartoning equipment as well as varying sizes of cartons. A motion profile for the plucking head 52 may be configured for each individual carton blank size, shape, style, etc. One or more such profiles may be saved in a memory within or associated with the controller 140 for use in future scenarios when the same carton blank is utilized again.

The foregoing has been presented for purposes of illustration and description. It is not intended to be exhaustive or to limit the embodiments to the precise form disclosed. Obvious modifications and variations are possible in light of the above teachings. For example, the described embodiment utilizes two linkage assemblies 180 and two vacuum cups 214 per plucking head 52 while alternate embodiments may include one, three, or four similar linkage assembly/plucking head arrangements positioned along the support rods 144 and 150 allowing the transportation of one or more cartons in each cycle. Of course, corresponding support trays, glue nozzles, and other components would be required including multiple carton stacks and a suitably modified hopper. All such modifications and variations are within the scope of the appended claims when interpreted in accordance with the breadth to which they are fairly, legally and equitably entitled.

What is claimed:

1. A carton blank feeding and shuttle machine, comprising:

first and second opposing sides, each side supporting a motor for driving a belt around a plurality of pulleys;

first and second rods extending between and supported for non-rotational movement relative the first and second opposing sides, a first end of the first rod attached to a first belt, a first end of the second rod attached to a second belt, and a second end of the first rod supported for movement relative the first end of the first rod and a second end of the second rod supported for movement relative the first end of the second rod;

a plucking head supported by the first and second rods such that relative movement of the first and second belts moves the plucking head from a first position to a second position; and a controller controlling the motor of each side.

2. The carton blank feeding and shuttle machine of claim 1, wherein the second end of the first rod is attached to a third belt and the second end of the second rod is attached to a fourth belt.

3. The carton blank feeding and shuttle machine of claim 2, wherein the third and fourth belts are each driven.

4. The carton blank feeding and shuttle machine of claim 3, wherein the first side supports a first motor and the second side supports a second motor, and the first motor drives the first and third belts and the second motor drives the second and fourth belts.

5. The carton blank feeding and shuttle machine of claim 1, wherein each end of the first and second rods is supported by a block.

6. The carton blank feeding and shuttle machine of claim 1, wherein each side supports a guide rail.

7. The carton blank feeding and shuttle machine of claim 6, wherein the first belt is driven through a first guide rail and the second belt is driven through a second guide rail.

8. The carton blank feeding and shuttle machine of claim 1, wherein the plucking head includes at least one linkage assembly supported by the first and second rods.

9. The carton blank feeding and shuttle machine of claim 1, wherein the plucking head includes first and second linkage assemblies supported by the first and second rods, and wherein a support bar extends between the first and second linkage assemblies and supports at least one vacuum cup attached to first and second supports associated with each linkage assembly.

10. The carton blank feeding and shuttle machine of claim 1, wherein the first and second opposing sides are attached to a frame.

11. The carton blank feeding and shuttle machine of claim 10, further comprising a hopper attached to the frame.

12. The carton blank feeding and shuttle machine of claim 11, wherein the hopper is configured to support at least one stack of carton blanks such that a next-in-line carton blank can be secured by the plucking head from a side of the at least one stack of carton blanks facing the frame.

13. A carton blank erector, comprising:

a frame supporting at least one of a carton former and a take-away conveyor;

a feeding and shuttle machine including (a) first and second opposing sides, each side supporting a motor for driving a belt around a plurality of pulleys, (b) first and second rods extending between the first and second opposing sides, a first end of the first rod attached to a first belt, a first end of the second rod attached to a second belt, and a second end of the first rod supported for movement relative the first end of the first rod and a second end of the second rod supported for movement relative the first end of the second rod, and (c) a plucking head supported by the first and second rods such that common movement of the first and second belts moves the plucking head along a reciprocating path and relative movement of the first and second belts moves the plucking head from a first position to a second position; and a controller controlling the motor of each side.

14. A carton blank feeding and shuttle machine for plucking a next-in-line carton from a stack of cartons supported by a hopper of a carton erector, comprising:

a plurality of rods extending between and attached to first and second sides;

a first servo drive supported by the first side for moving a first belt supported by a first group of pulleys supported by the second side;

a second servo drive supported by the second side for moving a second belt supported by a second group of pulleys supported by the first side;

a first end of a first rod attached to the first belt, a first end of a second rod attached to the second belt, and a second end of the first rod supported by one of the first and second sides for movement with the first end of the first rod and a second end of the second rod supported by one of the first and second sides for movement relative the first end of the second rod;

a head supported by the first and second rods such that movement of the first and second belts moves the head along a transfer path in a reciprocating manner and relative movement of the first and second belts moves the head from a first position to a second position; and a controller controls the first and second servo drives.

15. The carton blank feeding and shuttle machine for plucking a next-in-line carton from a stack of cartons supported by a hopper of a carton erector of claim 14, wherein the first servo drive moves a third belt supported by a third group of pulleys supported by the first side, and the second servo drive moves a fourth belt supported by a fourth group of pulleys supported by the second side.

16. The carton blank feeding and shuttle machine for plucking a next-in-line carton from a stack of cartons supported by a hopper of a carton erector of claim 15, wherein each end of the first and second rods is supported by a block.

17. The carton blank feeding and shuttle machine for plucking a next-in-line carton from a stack of cartons supported by a hopper of a carton erector of claim 15, wherein the first end of the first rod is supported by a first block attached to the first belt, a first end of the second rod is supported by a second block attached to the second belt, a second end of the first rod is supported by a third block attached to the third belt, and a second end of the second rod is supported by a fourth block attached to the fourth belt.

18. The carton blank feeding and shuttle machine for plucking a next-in-line carton from a stack of cartons supported by a hopper of a carton erector of claim 17, wherein the head includes at least one linkage assembly supported by the first and second rods.

19. The carton blank feeding and shuttle machine for plucking a next-in-line carton from a stack of cartons supported by a hopper of a carton erector of claim 18, wherein the head further includes at least one support arm attached to the at least one linkage assembly.

20. The carton blank feeding and shuttle machine for plucking a next-in-line carton from a stack of cartons supported by a hopper of a carton erector of claim 19, wherein the head further includes at least one push arm attached to the at least one support arm.

21. A method of shuttling a carton blank from an initial position to an intermediate position comprising the steps of:

driving first and second belts such that relative movement between the first and second belts extends a plucking head from a first position toward a carton stack supported by a hopper;

engaging a next-in-line carton blank in the initial position at a bottom of the carton stack;

further driving the first and second belts such that the next-in-line carton blank is pulled from the initial position in the carton stack and transported along a reciprocating transport path to the intermediate position;

releasing the next-in-line carton blank in the intermediate position;

further driving the first and second belts such that the head is returned along the reciprocating transport path to the carton stack for engaging a subsequent next-in-line carton blank in the initial position at the bottom of the carton stack.

22. The method of shuttling a carton blank from an initial position to an intermediate position of claim 21, further comprising the steps of further driving the first and second belts such that the subsequent next-in-line carton blank is pulled from the carton stack and transported toward the intermediate position;

engaging the next-in-line carton blank in the intermediate position and moving the next-in-line carton blank from the intermediate position toward a forward position;

releasing the subsequent next-in-line carton blank in the intermediate position; and further driving the first and second belts such that the head is again returned to the carton stack for engaging a subsequent next-in-line carton blank in the initial position at the bottom of the carton stack.

23. The method of shuttling a carton blank from an initial position to an intermediate position of claim 21, wherein the step of further driving the first and second belts such that the next-in-line carton blank is pulled from the initial position in the carton stack and transported to the intermediate position includes the steps of driving the first and second belts such that (a) relative movement of the first and second belts retracts the head pulling the next-in-line carton blank from the initial position (b) common movement of the first and second belts moves the next-in-line carton blank from the initial position to the intermediate position along a transfer path.

24. A method of shuttling a carton blank from an initial position to an intermediate position comprising the steps of:

driving first and second belts such that relative movement between the first and second belts extends a plucking head from a first position toward a carton stack supported by a hopper;

engaging a next-in-line carton blank in the initial position at a bottom of the carton stack;

further driving the first and second belts such that the next-in-line carton blank is pulled from the initial position in the carton stack and common movement between the first and second belts transports the next-in-line carton blank to the intermediate position;

releasing the next-in-line carton blank in the intermediate position;

further driving the first and second belts such that the head is returned to the carton stack for engaging a subsequent next-in-line carton blank in the initial position at the bottom of the carton stack.

25. The method of shuttling a carton blank from an initial position to an intermediate position of claim 24, further comprising the steps of further driving the first and second belts such that the subsequent next-in-line carton blank is pulled from the carton stack and transported toward the intermediate position; and engaging the next-in-line carton blank in the intermediate position and moving the next-in-line carton blank from the intermediate position toward a forward position.

* * * * *